US008434621B2

(12) United States Patent
Hun et al.

(10) Patent No.: US 8,434,621 B2
(45) Date of Patent: May 7, 2013

(54) WIPER BLADE PACKING CASE

(75) Inventors: Kim Tae Hun, Daegu (KR); Sang Cheol Lee, Daegu (KR); Jae Woong Kim, Daegu (KR)

(73) Assignee: Cap Corporation, Dalseo-gu, Daegu (KR)

( * ) Notice: Subject to any disclaimer, the term of this patent is extended or adjusted under 35 U.S.C. 154(b) by 0 days.

(21) Appl. No.: 13/266,774

(22) PCT Filed: Apr. 27, 2010

(86) PCT No.: PCT/KR2010/002646

§ 371 (c)(1),
(2), (4) Date: Oct. 27, 2011

(87) PCT Pub. No.: WO2010/126283

PCT Pub. Date: Nov. 4, 2010

(65) Prior Publication Data

US 2012/0043237 A1 Feb. 23, 2012

(30) Foreign Application Priority Data

Apr. 27, 2009 (KR) ..... 10-2009-0036596

(51) Int. Cl.
*B65D 75/04* (2006.01)
*B65D 73/00* (2006.01)

(52) U.S. Cl.
USPC ..... 206/471; 206/464; 206/806

(58) Field of Classification Search ..... 206/471, 206/776, 461, 464, 465, 470, 806; 229/128, 229/108, 108.1
See application file for complete search history.

(56) References Cited

U.S. PATENT DOCUMENTS

| | | | | | |
|---|---|---|---|---|---|
| 2,026,626 | A | * | 1/1936 | Gilfillan | 206/778 |
| 2,964,227 | A | * | 12/1960 | Goldsholl | 229/128 |
| 3,190,440 | A | * | 6/1965 | Palmer | 229/107 |
| 3,343,743 | A | * | 9/1967 | Hamilton, Jr. et al. | 229/117.24 |
| 3,765,594 | A | * | 10/1973 | Cramphorn | 229/106 |
| 3,929,222 | A | * | 12/1975 | Smith et al. | 206/783 |
| D248,375 | S | * | 7/1978 | Bergstein | D9/415 |
| 4,239,104 | A | * | 12/1980 | Roccaforte et al. | 206/526 |
| 4,378,903 | A | * | 4/1983 | Sherwood | 229/117.18 |
| 5,027,947 | A | * | 7/1991 | Reighart | 206/335 |
| 5,379,896 | A | * | 1/1995 | Snow et al. | 206/470 |
| 5,911,358 | A | * | 6/1999 | Kenner et al. | 229/116.1 |
| 5,924,626 | A | * | 7/1999 | Whitnell | 229/128 |
| 6,766,906 | B2 | * | 7/2004 | Charng | 206/470 |
| 7,258,233 | B2 | * | 8/2007 | Lee | 206/470 |
| 7,690,509 | B2 | * | 4/2010 | Herring et al. | 206/470 |

(Continued)

FOREIGN PATENT DOCUMENTS

KR 20-0226948 3/2001

OTHER PUBLICATIONS

International Search Report for PCT/KR2010/002646 mailed Dec. 29, 2010.

*Primary Examiner* — Steven A. Reynolds
(74) *Attorney, Agent, or Firm* — Christopher Paul Mitchell

(57) ABSTRACT

A wiper blade packing case including a plate-type lower panel; a plate-type upper panel; and a pair of covers, each of which has an elliptical cross-sectional surface corresponding to the cross-sectional surface of the receiving portion, and each of which is bent and extends from each of the shorter sides of the upper panel to close openings formed at both sides of the receiving portion.

4 Claims, 6 Drawing Sheets

U.S. PATENT DOCUMENTS

2003/0062284 A1 4/2003 Charng
2003/0185942 A1* 10/2003 Bishop et al. ..... 426/77
2005/0082185 A1* 4/2005 Lee ..... 206/335
2006/0006090 A1* 1/2006 Charng ..... 206/459.5
2006/0213799 A1* 9/2006 Muller ..... 206/469
2007/0235362 A1 10/2007 Lewis
2008/0073246 A1* 3/2008 Herring et al. ..... 206/776
2009/0145794 A1* 6/2009 Skurdalsvold et al. ..... 206/468
2011/0233087 A1* 9/2011 Skurdalsvold et al. ..... 206/349

* cited by examiner

WIPER BLADE PACKING CASE

RELATED APPLICATIONS

This application is a 371 application of International Application No. PCT/KR2010/002646, filed Apr. 27, 2010, which in turn claims priority from Korean Patent Application No. 10-2009-0036596, filed Apr. 27, 2009, each of which is incorporated herein by reference in its entirety.

TECHNICAL FIELD

The present invention relates to a wiper blade packing case, and in particular to a wiper blade packing case which provides a basic function of packing without deforming a wiper blade while reducing a transportation space, a storing space and an exhibit space in such a way to reduce a packing volume.

BACKGROUND ART

A vehicle is generally equipped with a wiper blade wiping a glass surface in order to obtain a clear vision ahead as a glass surface becomes contaminated by dusts in the air or depending on a weather condition.

A wiper blade is characterized in that it rotates at a certain angle while coming into close contact with a glass surface, thus efficiently wiping a glass surface and providing a good vision to a driver for a safety driving.

The wiper blade is needed to be exchanged as it is worn out due to a continuous operation and use and it loses its inherent adhering force or a wiping function, so the wiper blade is generally manufactured and sold in a disposable form with the body of the same being packed in a specific packing case.

The conventional wiper blade packing case is sold with a wiper blade being securely packed in an inner packing container, and the inner packing container is accommodated in an outer case.

The conventional wiper blade packing case needs a complicated and hard work when packing a wiper blade, and the inner packing container might easily escape from the outer case when an external force occurring during the transportation is applied thereto. When it is needed for a customer to check the state of a packed wiper blade, the external case should be cut and open. Since the inner packing container and the external case are separately manufactured from each other, the processes of manufacture disadvantageously increases, and more materials are needed, thus resulting in an increase in the manufacture cost. Since the packing volume is bulky, the transportation and storing spaces increase, thus increasing an exhibit space.

DISCLOSURE OF INVENTION

Accordingly, it is an object of the present invention to provide a wiper blade packing case which provides a simplified packing construction and an inexpensive manufacture while reducing a packing volume and a transportation and storing space, thus decreasing an exhibit space as well.

To achieve the above object, there is provided a wiper blade packing case used to pack a vehicle wiper blade, which comprises a plate shaped lower panel which has a pair of longer sides and a pair of shorter sides and are curved in a horizontal direction with respect to a longitudinal direction of the plate shaped surface; a plate shaped upper panel which is bendable along a longitudinal side of one side of the upper panel and is cured in a horizontal direction with respect to a longitudinal direction of the plate shaped surface so that the accommodation part has an elliptical cross section shape for accommodating the wiper blade along with the lower panel, thus surrounding the plate shaped surface of one side of the lower panel; and a pair of covers which each have an elliptical cross section shape matching with a cross section shape of the accommodation part and each are bent and extended from each shorter side of the upper panel, thus covering the open sides of two sides of the accommodation part.

Here, there are further provided a slot which is formed at one plate shaped surface of one of the pair of the covers; and an extension which forms an engaging protrusion passing through and being engaged to the sot and is extended from one side of the lower panel.

The engaging protrusion is cut off in part from the plate shaped surface of the extension and is overlapped with the plate shaped surface of the extension and is engaged with the slot.

There is further provided a rib which is bent from one side of the cover at which the slot is formed, and comes into close contact with the plate shaped surface of the extension.

There is further provided an assistant cover which has an elliptical cross section shape matching with the cross section shape of the accommodation part and is bent and extended from the other side of the lower panel and is overlapped with the cover and covers the open side of the other side of the accommodation part.

ADVANTAGEOUS EFFECTS

The present invention is basically directed to providing a wiper blade packing case which provides a simplified packing construction and makes it possible to reduce a manufacture cost and a packing volume, thus reducing a transportation space and a storing space, which results in a reduced exhibit space in such a way to improve a conventional packing structure.

BRIEF DESCRIPTION OF THE DRAWINGS

The present invention will become better understood with reference to the accompanying drawings which are given only by way of illustration and thus are not limitative of the present invention, wherein.

MODES FOR CARRYING OUT THE INVENTION

Figure 1:
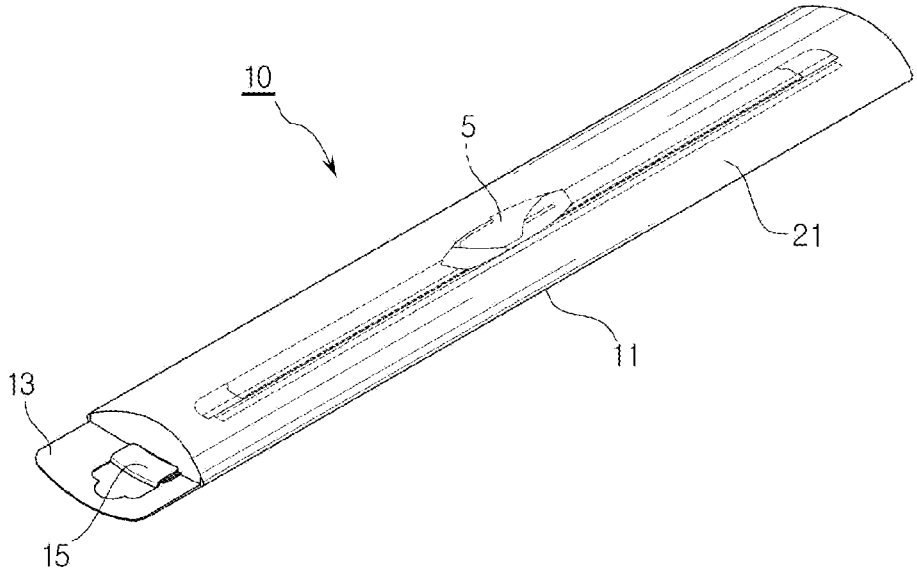
FIG. 1 is a perspective view illustrating a wiper blade packing case according to the present invention.
Figure 2:
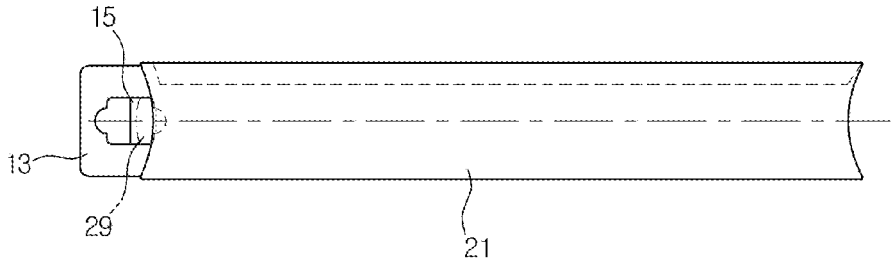
FIG. 2 is a plane view illustrating a wiper blade packing case according to the present invention.
Figure 3:
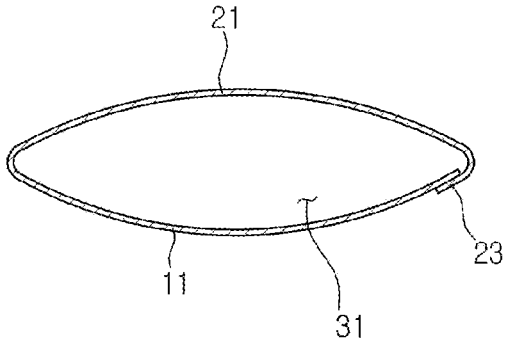
FIG. 3 is a vertical cross sectional view illustrating a wiper blade packing case according to the present invention.
Figure 4:
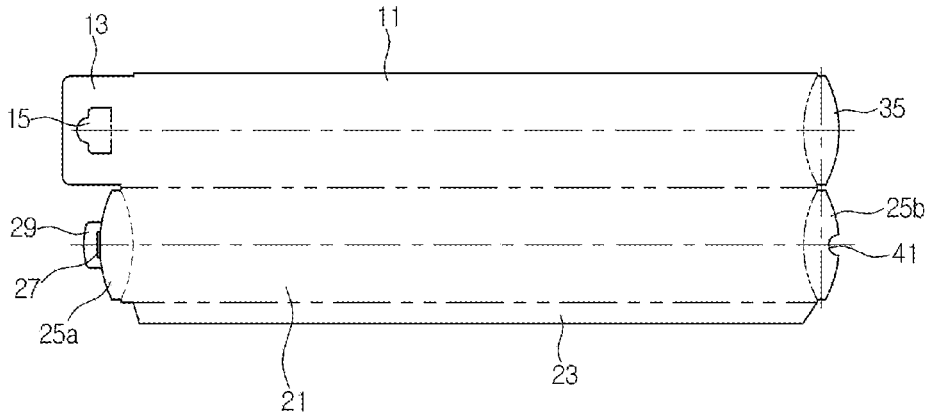
FIG. 4 is an exploded view illustrating a wiper blade packing case according to the present invention.

The preset invention will be described in details with reference to the accompanying drawings.

FIGS. 1 to 4 illustrate a wiper blade packing case according to the present invention. As shown therein, the wiper blade packing case 10 according to the present invention comprises a plate shaped lower panel 11, a plate shaped upper panel 21, and a pair of covers 25*a* and 25*b*.

The lower panel 11 has a pair of longer sides and a pair of shorter sides, respectively, and is curved with a certain radius being in a horizontal direction with respect to a longitudinal direction of a plate surface.

The lower panel 11 further includes an extension 13 extended from its one side and having a certain length. An engaging protrusion 15 passing though and engaged with a slot 27, which will be described later, is formed at an intermediate section of the extension 13. The engaging protrusion 15 is cut off in part from a plate shaped surface of the extension 13 and is folded along a plate shaped surface of the extension 13 and is finally engaged with the slot 27. The cut-off section of the extension 13 at which the engaging protrusion 15 is formed becomes an engaging hole which allows the wiper blade pacing case 10 of the present invention to be hung on an exhibit shelf for exhibits.

The upper panel 21 has the same cross section shape and dimension as the lower panel 11 and is foldable along a longitudinal side of the lower panel. The upper panel 21 is curved with the same curvature as the lower panel 11 in a horizontal direction with respect to a lengthwise direction of a plat shaped surface so that an accommodation part 31 has an elliptical cross section along with the lower panel 11 for accommodating the wiper blade 5, thus surrounding one plate shaped surface of the lower panel 11. Here, the lower panel 11 and the upper panel 21 might be curved with different curvatures.

An adhering part 23 coming into contact with the lower panel 11 is formed at an edge portion of the per panel 21 coming into contact with a longitudinal side of the other side of the lower panel 11 and is foldable-extended along a longitudinal side of the other side of the lower panel 11. The adhering part 23 is adhered with the lower panel 11 with the aid of an adhesive.

A pair of covers 25*a* and 25*b* each having an elliptical cross section shape matching with the cross section shape of the accommodation part 31 are bent and extended from each shorter side of the upper panel 21. The pair of the covers 25*a* and 25*b* are bent toward the plate shaped surface of the lower panel 11 from each shorter side of the upper panel 21 and covers the open sides of two sides of the accommodation part 31, thus maintaining a certain distance between the lower panel 11 and the upper panel 21.

A slot 27 is formed at a plate shaped surface of the cover 25*a* arranged near the extension 13 of the lower panel 11, and the engaging protrusion 15 is inserted into the slot 27. A rib 29 closely supported by the plate shaped surface of the extension 13 is bent and extended from one side of the cover 25*a* at which the slot 27 is formed. It is preferred that the slot 27 is formed at a bent section of the cover 25*a* and the rib 29. The cover 25*a* serves to maintain a certain distance between the lower panel 11 and the upper panel 21.

The lower panel 11 and the upper pane 21 define an accommodation part 31 having an elliptical cross section shape in whole, which helps form a simplified packing case structure, thus reducing a manufacture cost and a transportation space and a storing space by reducing a packing volume, which results in a reduced exhibit space for product exhibits.

An assistant cover 35 is provided at the other side of the lower panel 11 of the wiper blade packing case 10 according to the present invention, thus covering the open side of the other side of the accommodation part 31. It is preferred that the assistant cover 35 has an elliptical cross section shape matching with the cross section shape of the accommodation part 31 and is bent and extended from the other side of the lower panel 11 and is overlapped with the cover 25*b*, thus covering the open side of the other side of the accommodation part 31.

Here, reference numeral 41 represents a holding hole. The holding hole 41 helping easily open the open side of the accommodation part 31 is cut off in an arc shape in part from the edge portion of the cover 25*b*.

The operations that the wiper blade 5 is packed in the wiper blade packing case 10 according to the present invention will be described as follows.

Figure 5:
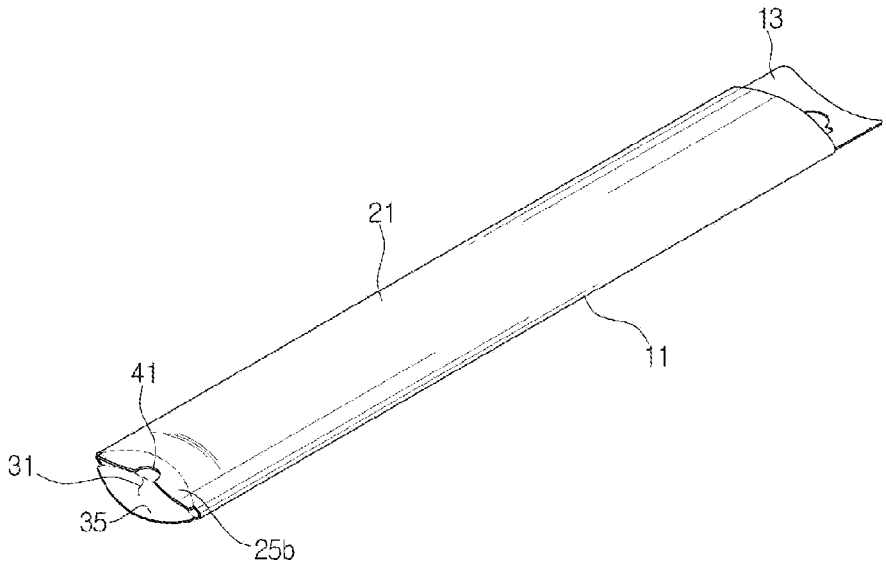
FIGS. 5 to 7 are perspective views illustrating a wiper blade packing case while illustrating an engaging procedure of a cover and an assistant cover of a wiper blade packing case according to the present invention.
Figure 6:
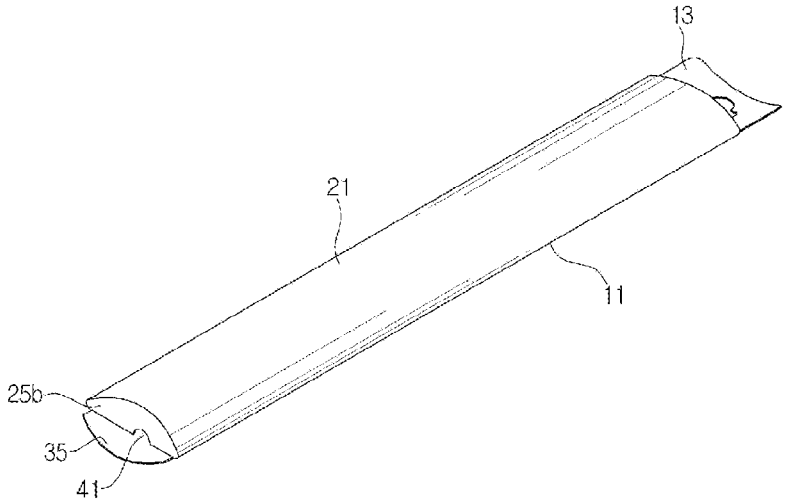
Figure 7:
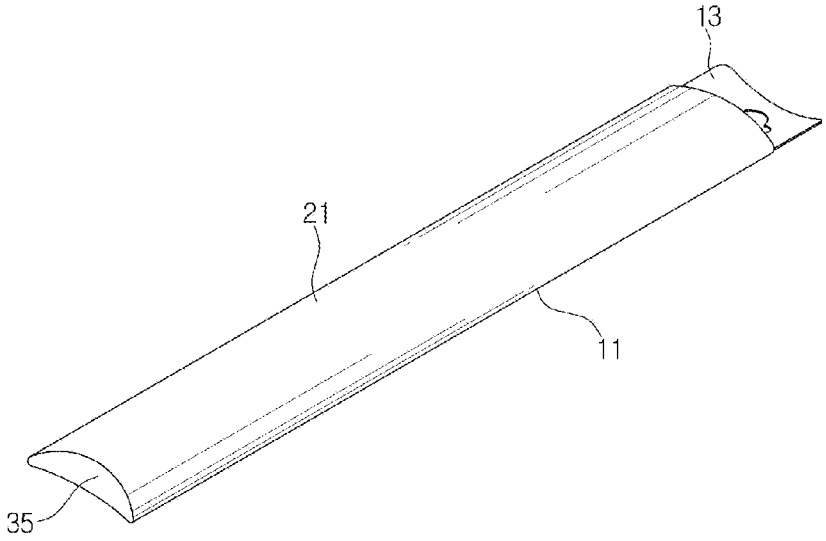

As shown in FIG. 5, with the open side of the other side of the accommodation part 31 being open, as shown in FIG. 6, the cover 25*b* is bent toward the plate shape surface of the lower panel 11, and the open side of the other side of the accommodation part 31 is covered, and as shown in FIG. 7, the assistant cover 35 is bent toward the plate shaped surface of the upper panel 21 in order to overlap with the cover 25*b*, and the cover 25*b* and the assistant cover 35 cover the open side of the other side of the accommodation part 31, respectively.

The wiper blade (not shown) to be packed is accommodated into the accommodation part 31 through the open side of one side of the accommodation part 31 disposed at the opposite side of the assistant cover 35.

Figure 8:
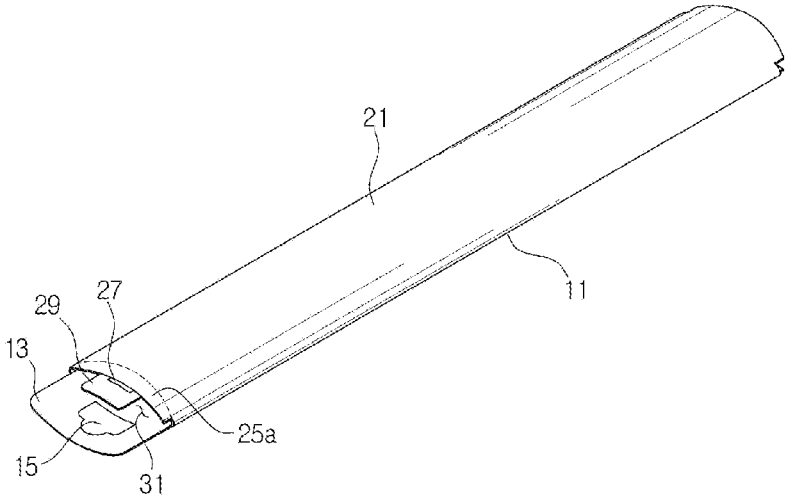
FIGS. 8 to 12 are perspective bottom views illustrating a wiper blade packing case while illustrating a procedure for inserting an engaging protrusion of a wiper blade packing case into a slot according to the present invention.
Figure 9:
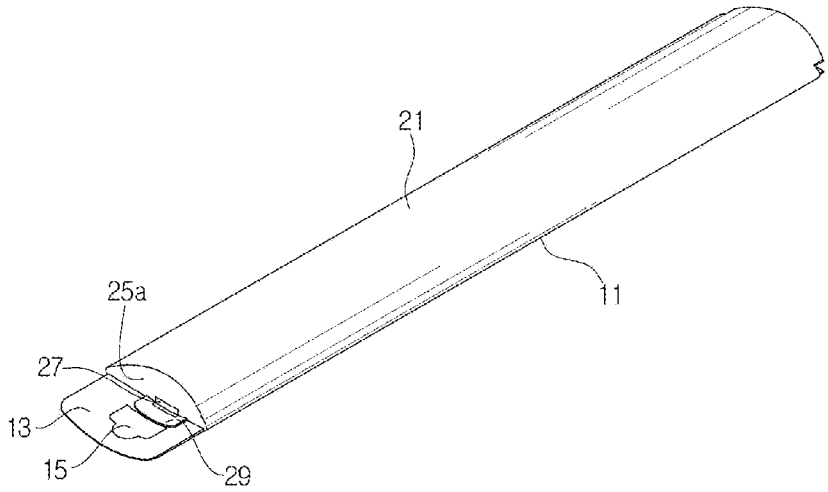

As shown in FIG. 8, with the open side of one side of the accommodation part 31 being open, as shown in FIG. 9, the cover 25*a* is bent toward the plate shaped surface of the lower panel 11, and the open side of one side of the accommodation part 31 is covered, and at the same time the rib 29 is bent and forced to come into close contact with the plate shaped surface of the extension 13.

Figure 10:
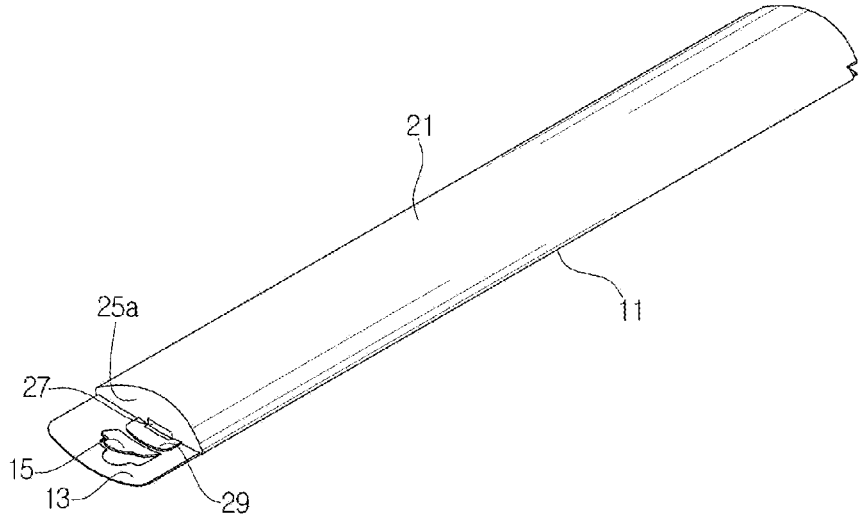
Figure 11:
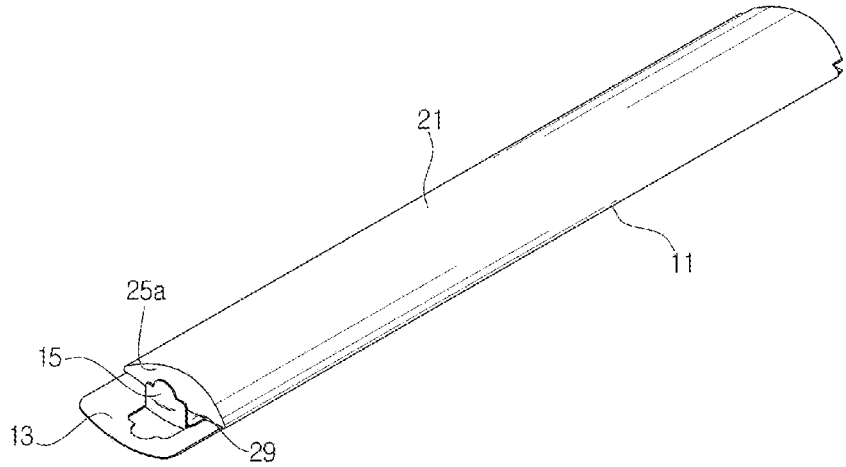
Figure 12:
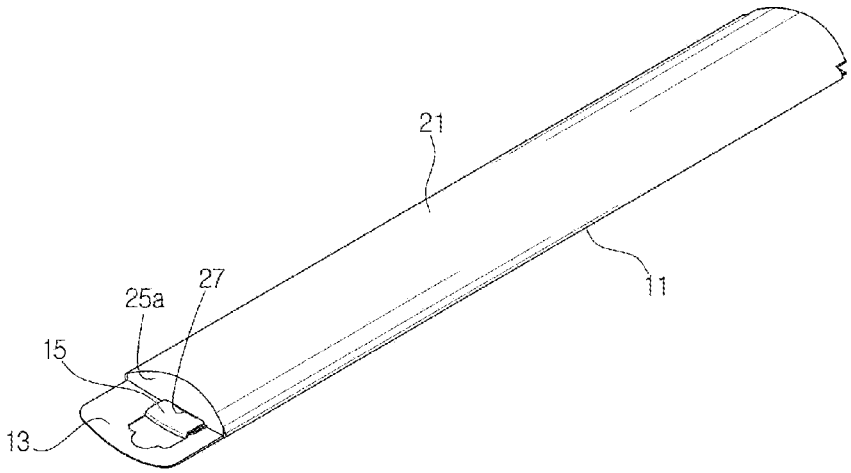

As shown in FIGS. 10 and 11, the engaging protrusion 15 is made to be spaced apart from the plate shaped surface of the extension 13, and as shown in FIG. 12, it is folded along the plate shaped surface of the extension 13 and is inserted into the slot 27 of the cover 25*a*. At this time, the engaging protrusion 15 is securely supported in such a way to overlap the rib 29 on the plate shaped surface of the extension 13, and is inserted into the slot 27 of the cover 25*a*, so the cover 25*a* is not easily open by means of an external force.

In the above manner, the packing procedure of packing the wiper blade 5 into the wiper blade case 10 according to the present invention is finished.

The wiper blade packing case 10 according to the present invention is made from a synthetic resin, and is preferably made from an invisible material in part or in whole, so a customer can see through.

The present invention is not limited to the above described embodiments and might be modified and amended in various forms not departing from the concept and scope of the present invention by an ordinary person skilled in the art; however such modifications or changes belong to the scope of the claims of the present invention.

The invention claimed is:

1. A wiper blade packing case used to pack a vehicle wiper blade, comprising:

a plate shaped lower panel which has a pair of longer sides and a pair of shorter sides and is curved in a horizontal direction with respect to a longitudinal direction of a plate shaped surface;

a plate shaped upper panel which is bendable along a longitudinal side of one side of the upper panel and is curved in a horizontal direction with respect to a longitudinal direction of the plate shaped surface so that an accommodation part has an elliptical cross section shape for accommodating the wiper blade along with the lower panel, thus surrounding the plate shaped surface of one side of the lower panel;

a pair of covers which each have an elliptical cross section shape matching with a cross section shape of the accommodation part and each is bent and extended from each shorter side of the upper panel, thus covering open sides of two sides of the accommodation part;

a slot which is formed at one plate shaped surface of one of the pair of the covers;

an extension which forms an engaging protrusion passing through and being engaged to the slot and is extended from one side of the lower panel; and a cut-off section of the extension at which the engaging protrusion is formed serves an engaging hole which allows the wiper blade packing case to be hung on.

2. A wiper blade packing case used to pack a vehicle wiper blade according to claim 1, wherein said engaging protrusion is cut off in part from the plate shaped surface of the extension and is overlapped with the plate shaped surface of the extension and is engaged with the slot.

3. A wiper blade packing case used to pack a vehicle wiper blade according to claim 2, further comprising:

a rib which is bent from one side of the cover at which the slot is formed, and comes into close contact with the plate shaped surface of the extension.

4. A wiper blade packing case used to pack a vehicle wiper blade according to claim 1, further comprising:

an assistant cover which has an elliptical cross section shape matching with the cross section shape of the accommodation part and is bent and extended from the lower panel and is overlapped with a corresponding one of the pair of covers and covers the open side of the other side of the accommodation part.

* * * * *